United States Patent [19]

Anderson

[11] Patent Number: 4,848,490

[45] Date of Patent: Jul. 18, 1989

[54] DOWNHOLE STABILIZERS

[76] Inventor: Charles A. Anderson, 78A Stanley Street, Aberdeen AB1 6UQ, Great Britain

[21] Appl. No.: 62,203

[22] Filed: Jun. 15, 1987

[30] Foreign Application Priority Data

Jul. 3, 1986 [GB] United Kingdom ..... 8616211
Jul. 15, 1986 [GB] United Kingdom ..... 8617259

[51] Int. Cl.[4] ..... E21B 7/04; E21B 17/10

[52] U.S. Cl. ..... 175/323; 175/325; 175/76

[58] Field of Search ..... 175/323, 325, 61, 73, 175/76

[56] References Cited

U.S. PATENT DOCUMENTS 3,051,255 8/1962 Deely ..... 175/325
3,129,776 4/1964 Mann ..... 175/76
4,046,204 9/1977 Takaoka ..... 175/76
4,388,974 6/1983 Jones, Jr. et al. ..... 175/76

FOREIGN PATENT DOCUMENTS 0751956 7/1980 U.S.S.R. ..... 175/325
0857416 8/1981 U.S.S.R. ..... 175/325
0956729 9/1982 U.S.S.R. ..... 175/76

*Primary Examiner*—Jerome W. Massie, IV
*Assistant Examiner*—Terry Lee Melius

[57] ABSTRACT

There is described a directional downhole stabilizer for use in a drill string. The stabilizer has an effective diameter which is selectively variable between a minimum diameter and a maximum diameter depending on the load on the drill string. The effective diameter is determined by radially movable spacers which are caused to move radially on relative movement of a mandrel which telescopes within the stabilizer casing and which has cam surfaces which engage the radial spacers. The telescopic movement of the mandrel within the casing is controlled via a mechanical detect arrangement which is actuated by the compressive force on the stabilizer.

15 Claims, 6 Drawing Sheets

DOWNHOLE STABILIZERS

This invention relates to downhole stabilisers for use in a drill string during directional drilling.

BACKGROUND OF THE INVENTION

In the oil and gas industries it is often desirable to drill a number of wells from a single surface location. Each well extends downwardly and outwardly from the surface location in a different direction from the other wells, i.e. in various different combinations of compass bearing, inclination from vertical, and depth below surface. The initial portion of the well (the section nearest the surface) may be vertical or inclined to the vertical. The direction of drilling frequently requires to be changed, to increase or decrease the inclination of the well, or to correct for an unintended change in direction such as may be caused by geological conditions. Such techniques are generally known as directional drilling.

Directional drilling is especially useful in offshore production of oil and gas since the procedure enables a large area to be drilled from a single platform. However, directional drilling requires effective and efficient control of direction.

In directional drilling, control of direction may be undertaken by downhole stabilisers. In the most general terms, known forms of downhole stabilisers consist of a collar-like device or asembly fitting around or into a drill string near the lower end of the string. A fixed stabiliser will centralise the drill string and tend to straighten the well being drilled. Replacement of such a fixed stabiliser with one of lesser diameter will allow the drill string to bow, and thus sustain or increase curvature of the well being drilled. Upon achievement of the desired direction after curved drilling, a maximum diameter stabiliser will normally tend to maintain the desired direction by straight drilling.

With each change in diameter of a fixed stabiliser, the entire drill string must be withdrawn to have the stabiliser removed from the string and replaced by another stabiliser of the requisite different diameter, followed by reinsertion of the string down the well. With the intention of avoiding such unproductive activity, proposals have been made for downhole stabilisers whose effective diameter can be varied under remote control such that a stabiliser near the bottom of a well can have its diameter adjusted under control from the surface location and without being raised to the top of the well. However, such adjustable stabilisers have either required hydraulic systems, or excessively complicated mechanical systems. In the mechanical systems, either an actuating link was needed from the surface location to the stabiliser, or continuous control of the downward force on the drill string was needed to effect stabiliser diameter changes. In particular, previous designs of downhole stabiliser not requiring a downhole link additional to normal drill string components did not also have the ability to operate with a full range of normal drilling forces independently of diameter-changing operation of the stabiliser.

It is therefore an object of the invention to provide a downhole stabiliser which obviates or mitigates these disadvantages.

SUMMARY OF THE INVENTION

According to the present invention there is provided a downhole stabiliser for use in a drill string, the stabiliser having an effective diameter which is selectively variable between a minimum diameter and a maximum diameter, the stabiliser comprising a hollow and generally cylindrical casing having a string coupling at one end thereof, the casing mounting an angularly distributed array of radially movable radial spacers whose radially outer ends define said effective diameter, the casing internally and co-axially mounting a spacer actuating mandrel, the mandrel having a string coupling at one end thereof, the string coupling on the casing and the string coupling on the mandrel being at opposite ends of the downhole stabiliser to allow the downhole stabiliser to be operatively coupled into the drill string in use, the stabiliser being capable of telescopic contraction and extension between said string couplings by means of axially limited insertion of said mandrel into said casing and withdrawal of said mandrel from said casing, said mandrel and said casing being coupled to prevent relative rotation thereof, the mandrel having at least one camming surface, the radial spacers each having a camming surface on the respective radially inner end thereof, the camming surfaces on the mandrel and on the radial spacers cooperating to force the radial spacers radially outwards upon telescopic contraction of the downhole stabiliser by increased insertion of the mandrel into the casing, a mechanical detent within said casing and linking the casing with the mandrel in an axially extended condition of the stabiliser to restrain said telescopic contraction of the stabiliser while axially compressive forces on the stabiliser remain below a predetermined critical force, said detent being operable by application to the downhole stabiliser of an axially compressive force exceeding said critical force to release the mandrel from the casing to allow said telescopic contraction of the downhole stabiliser and consequent radial extension of said radial spacers, said detent allowing the stabiliser t remain in the contracted condition to retain said radial spacers in their radially outward positions until axially compressive forces on the stabiliser fall below a predetermined minimum axially compressive force to release the mandrel relative to the casing thus to allow the stabiliser to return to the axially extended condition and consequently to allow radial retraction of the radial spacers.

The casing, the mandrel, and both string couplings are preferably hollow throughout the length of the stabiliser and are mutually sealed to be substantially fluid-tight to permit drilling mud to be pumped under pressure through the stabiliser when it is incorporated as part of a drill string.

Preferably, the mechanical detent is a resilient catch coupled through a spring to the casing, said spring having a pre-load thereon which determines said critical force, said catch being coupled to the mandrel in the telescopically extended condition of the stabiliser through a ramp formed on the mandrel, application to the stabiliser of an axially compressive force exceeding said critical force causing contraction of the pre-loaded spring and riding of the catch over said ramp to allow said increased insertion of the mandrel into the casing.

The casing preferably includes a catch restraint which restrains the catch from riding over the ramp while the spring is uncontracted in the absence of an axially compressive force on the stabiliser which is in excess of the critical force.

Preferably, said resilient catch is formed as an annular array of fingers each free at one end and integral at the other end with the other fingers, the material of which the catch is formed giving resilient movement to the free ends of the fingers, the ramp on the mandrel being formed as an annular shoulder against which the free ends of the fingers are resiliently contracted.

The catch restraint is preferably an annular intrusion on the inner surface of the casing and bearing against the free ends of the catch fingers in the telescopically extended condition of the stabiliser to give positive restraint to the free ends of the fingers and to prevent the free ends of the fingers from riding over the annular shoulder on the mandrel prior to initiation of telescopic contraction of the stabiliser by application of an axial compressive force in excess of the critical force.

The spring preferably comprises a stack of belleville washers held in a cage between end stops which limit axial expansion of the stack to provide said pre-load. The mandrel preferably has the or each camming surface thereon formed as a respective conical surface co-axial with the mandrel.

According to another aspect of the invention there is provided a downhole stabiliser for use in a drill string, the stabiliser having an effective diameter which is selectively variable between a minimum diameter and a maximum diameter by application to the downhole stabiliser of an axially compressive force exceeding a critical force to allow telescopic contraction of the downhole stabiliser, the stabiliser mounting an angularly distributed array of radially movable radial spacers whose radially outer ends define said effective diameter, adjacent spacers in said array being mutually angularly spaced by substantially equal angles around the periphery of the stabiliser, and the whole array of spacers being distributed at least once around the entire periphery of the stabiliser.

Said angularly distributed radial spacers are preferably also axially distributed with adjacent spacers in said array being mutually axially spaced along the periphery of the stabiliser.

Said array of spacers preferably forms at least one helix on the periphery of the stabiliser with successive spacers in the or each helix being mutually spaced at substantially regular increments of angle and of axial separation. Said array of spacers preferably forms three mutually equidistant helices.

Each radial spacer is preferably a substantially cylindrical body slidingly mounted in a respective substantially cylindrical hole in the stabiliser, and with the axis of each such cylindrical body aligned substantially at right angles to the axis of the stabiliser.

The radially outer end of each radial spacer is preferably coated or otherwise covered with a layer of non-ferrous wear-resistant material, which may be tungsten carbide.

BRIEF DESCRIPTION OF THE DRAWINGS

Embodiments of the invention will now be described, by way of example, with reference to the accompanying drawings, in which.

DESCRIPTION OF PREFERRED EMBODIMENT

Figure 1:
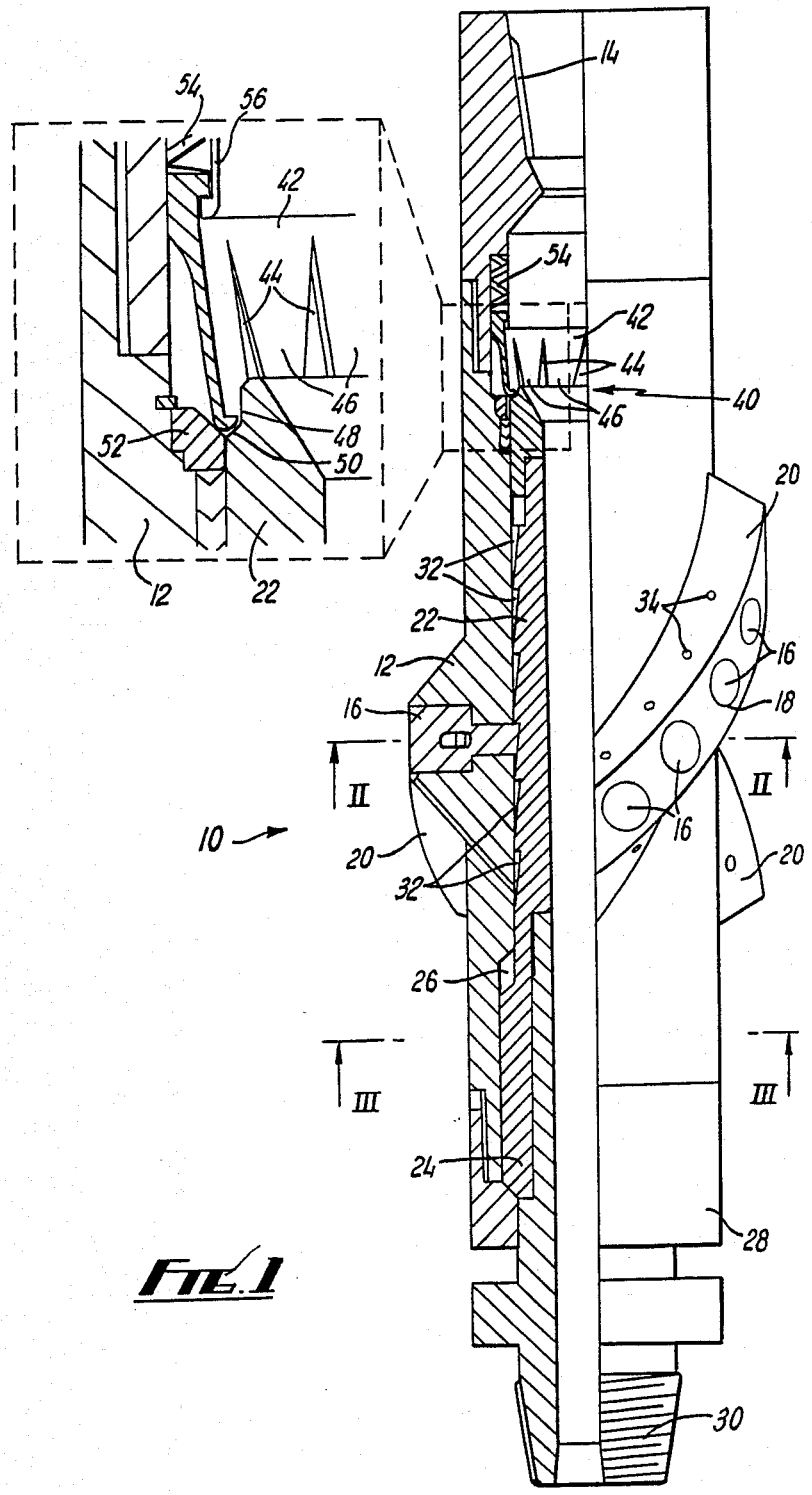
FIG. 1 is a part-sectional side view of a first embodiment of the downhole stabiliser of the present invention.

Referring first to FIG. 1, a downhole stabiliser 10 includes a hollow and generally cylindrical casing 12 having a string coupling 14 at its upper end. The coupling 14 is an oil industry standard tapered pipe thread (female) dimensioned to connect with a corresponding male tapered pipe thread on a drillpipe or other standard drill string component, to make a mechanical connection for transmission of drilling forces and a hydraulic connection for passage of pressurised drilling mud.

The stabiliser casing 12 mounts an array of radial spacers 16. Each spacer 16 is generally cylindrical and is slidingly mounted in a corresponding radially aligned bore 18 in the casing 12. Each spacer 16 can be allowed to retract radially into the casing 12 until the radially outer end of the spacer 16 no longer protrudes from the casing 12, or forced to extend radially out of the casing 12 until the radially outer end of the spacer 16 protrudes from the casing 12. (The mechanism for selectively either forcing radial extension or allowing radial contraction of the radial spacers 16 will be detailed below).

The radially outer ends of the radial spacers 16 will normally be the radially outermost portions of the stabilisers 10 and thus define the effective diameter of the stabiliser. When the spacers 16 are fully retracted into the casing 12, the effective diameter of the stabiliser 10 is at a minimum diameter, and conversely, when the radial spacers 16 are radially extended by their full extent, the effective diameter of the stabiliser 10 is then at a maximum diameter. Since the radially outer ends of the spacers 16 will be subjected to severe abrasive forces during use of the stabiliser 10, these outer ends are preferably coated or otherwise covered with a layer of non-ferrous wear resistant material, such as tungsten carbide.

The array of spacers 16 is distributed around the effective diameter or periphery of the stabiliser 10 in order to give more efficient presentation of bearing surface to the bore of the well. Adjacent spacers 16 in the array are preferably mutually angularly spaced by substantially equal angles, and preferably also distributed at least one around the entire periphery of the stabiliser 10, to equalise the radial load bearing capacity in all directions as far as is possible. Since there may be insufficient angular separation (or even angular overlap) between adjacent radial spacers, the spacers 16 may also be axially spaced along the periphery of the stabiliser 10 to achieve the necessary separation of adjacent spacers (by a combination of angular separation and axial separation).

Figure 2:
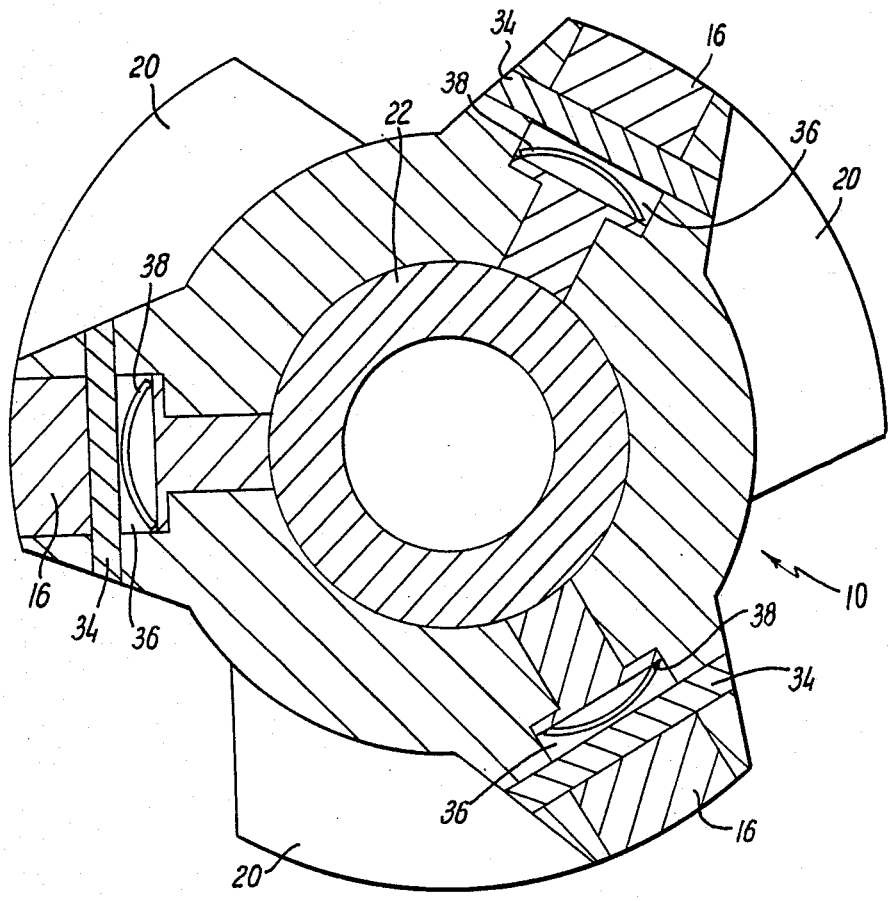
FIG. 2 is a cross-sectional view on line II—II in FIG. 1.

While the radial spacers 16 can be distributed in any suitable form of array, they are preferably arranged in three helices as shown in FIGS. 1 and 2. The periphery of the casing 12 is preferably formed as three fixed helical buttresses 20 through which the spacers 16 extend. The illustrated tri-helical arrangement has optimal structural and functional properties. The peripheral faces of the buttresses 20 may also be hard-faced with tungsten carbide.

Details of the mechanism for radially extending the spacers 16 will now be given.

Figure 3:
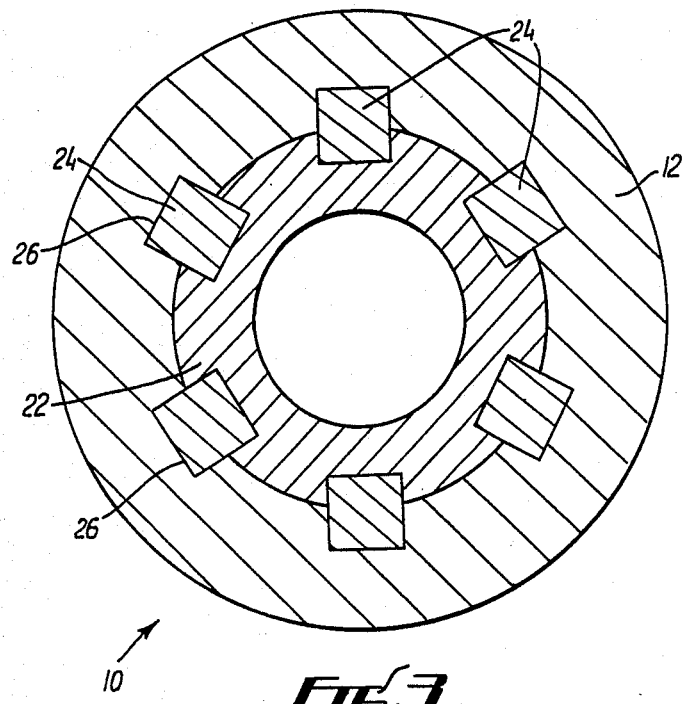
FIG. 3 is a cross-sectional view on line III—III in FIG. 1.

The hollow cylindrical stabiliser casing 12 internally and co-axially mounts a spacer-actuating mandrel 22. The mandrel 22 can slide axially within the casing 12, but is prevented from rotating relative to the casing 12. Rotation is prevented by means of a set of keys 24 fixed into and protruding from the mandrel 22 and sliding in axial channels 26 inside the casing 12 (FIGS. 1 and 3). Since the axial lengths of the keys 24 is less than the axial length of the casing key channels 26 (see FIG. 1), the mandrel 22 can have its insertion into the casing 12 increased from the illustrated condition of maximum telescopic extension of the stabiliser 10. Withdrawal of the mandrel 22 axially out of the casing 12 beyond the position shown in FIG. 1 is prevented by a screwed-on lower end cap 28 on the casing 12.

The lower end of the mandrel 22, which projects clear of the casing 12, is terminated in a string coupling 30 that is the male counterpart of the string coupling 14 (previously detailed). The string couplings 14 and 30 allow the stabiliser 10 to be operatively coupled into a drill string during use of the stabiliser 10, while the keys 24 permit the transmission of drilling torque and rotation through the stabiliser 10. The casing 12 and the mandrel 22, together with both the string couplings 14 and 30, are hollow throughout the length of the stabiliser 10 and mutually sealed to permit drilling mud to be pumped under pressure through the stabiliser 10 when it is incorporated as part of a drill string.

The radially inner end of each radial spacer 16 has a wedge-shaped camming surface in the form of a substantially planar surface inclined at a small angle (preferably 5–15 degrees) to the longitudinal axis of the stabiliser 10. The mandrel 22 has matching camming surfaces in the form of a series of part-conical steps 32 machined in its external surface at substantially the same angle to the longitudinal axis as the inner ends of the spacers. Each part-conical step 32 is circumferentially continuous to obviate any necessity or a specific angular alignment between the mandrel 22 and the casing 12 during assembly of the stabiliser 10. The mutual axial spacings of the steps 32 correspond to the axial spacings of adjacent spacers 16, such that the camming surfaces 32 on the mandrel 22 will simultaneously engage each camming surface formed by the inner end of each of the radial spacers 16.

Telescopic contraction of the stabiliser 10 between the string couplings 14 and 30 by increased insertion of the mandrel 22 into the casing 12 results in the part-conical camming surfaces 32 wedging against the inner ends of the radial spacers 16 to force the spacers 16 to extend radially outwards from the casing 12. Radial extension of the spacers 16 increases the effective diameter of the stabiliser 10 from its minimum diameter (spacers 16 fully retracted) to its maximum diameter (spacers 16 fully extended).

Excessive outward movement of the spacers 16 is prevented by retaining pins or screws 34 fixed into the buttresses 20 and passing through transverse slots 36 in the spacers 16. Within each spacer 16, a small leaf spring 35 may optionally be fitted between the retaining screw 34 and the inboard end of the slot 36 to bias the spacer 16 to its retracted position when not forced out by telescopic contraction of the stabiliser 10. However, the high radial force encountered by the outer ends of the spacers 16 during use of the stabiliser 10 may allow these springs 38 to be dispensed with, since these radial forces would suffice to ensure retraction of the spacers 16 into the casing 12 when no forcibly extended.

It is an important feature of the downhole stabiliser of the invention that there is an absence of any connection between the stabiliser and the surface location of the top of the well, which is additional to the conventional drill string components (such as coupled lengths of drill pipe). Control of the stabiliser 10 is effected by an axially compressive force on the stabiliser 10 applied down the drill string from the surface location (and reacted by the drill bit bearing against the bottom of the well). This diameter-changing control force is purely mechanical in nature in that it is functionally independent of hydraulic operational forces (due normally to the pumping of drilling mud down the drill string). In order to allow a normal range of drilling forces without unintended change in affective diameter of the stabiliser, but nevertheless to ensure reliable diameter-changing operation by a selected axially compressive force, the casing 12 and the mandrel 22 are linked by a mechanical detent 40 which will only release the mandrel 22 for increased insertion into the casing 12 when the downhole stabiliser 10 is subjected to an axially compressive force which is above a critical force. The critical force is preferably arranged to be suitably in excess of the maximum force applied during normal drilling operations.

Certain features of the detent 40 are shown to an enlarged scale in the inset to FIG. 1. Part of the detent 40 consists of an annular catch 42 formed as a generally cylindrical sleeve of resilient material divided by axial cuts 44 into an annular array of fingers 46 each free at one end and integral at the other end with the other fingers 46. The resilience of the material of the catch 42 results in the free ends of the fingers 46 being biased radially inwards of the catch 42. The end of the mandrel 22 remote from the string coupling 30 and nearest the string coupling 14 on the casing 12 is formed with an annular shoulder 48 whose axially inner end is tapered to form a ramp 50. The free ends of the catch fingers 46 resiliently contract against the annular shoulder 48, and axially restrain the mandrel 22 axial by contact with the ramp 50. An annular catch restraint 52 protrudes inwardly from the inner wall of the casing 12 to present a conically tapered surface in opposition to the mandrel ramp 50 when the mandrel 22 is maximally extended from the casing 12 (i.e. the stabiliser 10 is at its maximum length). The catch restraint 52 positively restrains the free ends of the catch fingers 46 to prevent them riding over the mandrel shoulder ramp 50 prior to initiation of telescopic contraction of the stabiliser 10 by application of an axial compressive force in excess of the critical force.

The resilient catch 42 is coupled to the casing 12 through a compression spring 54 which is pre-loaded to determine the critical force. The spring 54 is in the form of a stack of belleville washers held within a cage 56 between end stops which limit axial expansion of the stack to provide the pre-load. The pre-load is made sufficiently high that any normal drilling force applied through the drill string is insufficient to cause further compression of the pre-loaded spring 54.

When the stabiliser 10 is subjected to an axially compressive force in excess of the critical force, the mandrel 22 is forced further into the casing 12, against the pre-loaded spring 54 whose force is transmitted to the mandrel 22 by the catch 42 whose fingers 46 bear against the mandrel shoulder ramp 50. When the mandrel 22 is sufficiently inserted into the casing 12, the shoulder ramp 50 moves clear of the catch restraint 52 and the free ends of the fingers 46 are released to ride out over the shoulder ramp 50, whereupon they drop down the outer surface of the mandrel 22. The detent 40 has now released the mandrel 22 relative to the casing (in terms of sprung restraint, though not in respect of rotational and axial restraint provided by the keys 24). Thus, the stabiliser 10 is now free to contract telescopially to its minimum overall length, with consequent radial extension of the spacers 16 to give the stabiliser 10 its maximum effective diameter.

Once the detent 40 is sprung free of the mandrel shoulder ramp 50, the detent 40 causes no further restraint to relative movement of the mandrel 22 and the casing 12 (save for minimal friction of the free ends of the fingers 46 sliding along the surface of the mandrel 22). Thus, a full range of normal drilling forces can be applied to the drill string, and it is not necessary to maintain a particular axial force to retain the stabiliser 10 at its maximum diameter. . Correspondingly, to re-extend the stabiliser telescopically back to its original length, it is necessary only to apply axial tension (a negative axially compressive force) between the string couplings 14 and 30, of a magnitude sufficient to overcome remanent friction forces. It will normally suffice to lift the drill string at the surface drilling location, whereupon the weight of drill string components below the lower string coupling 30 will tend to hold down the mandrel 22 while the casing 12 is lifted by the upward force applied to the upper string coupling 14. When the stabiliser 10 returns to the axially extended condition, the detent 40 will re-engage the mandrel shoulder ramp 50 to latch the stabiliser 10 in its axially extended condition. Simultaneously the mandrel camming surfaces 32 will be pulled out of wedging engagement with the inner ends of the radial spacers 16 to cease forcing the spacers 16 into their radially extended positions. This allows the spacers 16 to retract radially, under a combination of forces from the springs 38 (if provided) and the normally high radially inward forces applied to the radially outer ends of the spacers 16 by their contact with the wall of the well being drilled. (This will also automatically allow retraction of the radial spacers 16 when the stabiliser 10 is being lifted out of a well).

Once the stabiliser 10 is telescopically contracted and returned to its minimum diameter condition where it is latched by the detent 40, a full range of normal drilling forces can be re-applied without switching back to the maximum diameter condition. Return to maximum diameter can be achieved when required merely by the temporary application of an axially compressive force in excess of the critical force. Thus, changes in the effective diameter of the stabiliser 10 can be accomplished at will merely by the temporary application to the drill string either of an abnormally high force (to increase the effective diameter to the maximum) or of a lifting force (to decrease the effective diameter to the minimum). It is not necessary in either case to lift the stabiliser to the surface to alter its diameter, nor is there any restraint on normal drilling forces apart from the brief period of diameter-changing force or lift. There is a total absence of special connections down the drill string, and hydraulic forces are not involved in operation of the stabiliser since it is purely mechanical.

Figure 4:
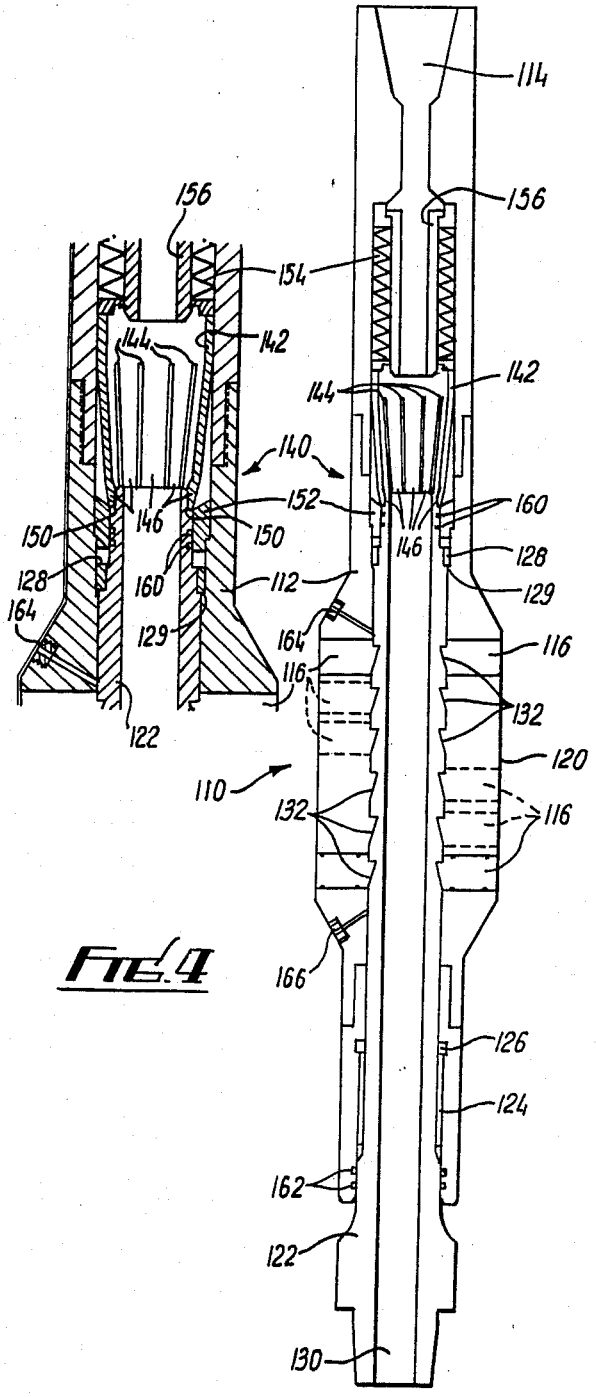
FIG. 4A is a part-sectional side view of a second embodiment of the downhole stabiliser o the present invention.
FIG. 4B is an exploded par-sectional side view of the downhole stabiliser shown in FIG. 4A.
Figure 4B:
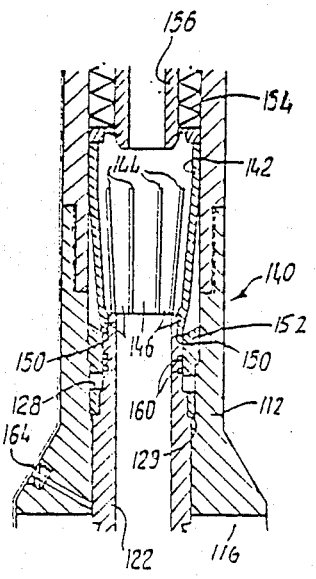
Figure 4A:
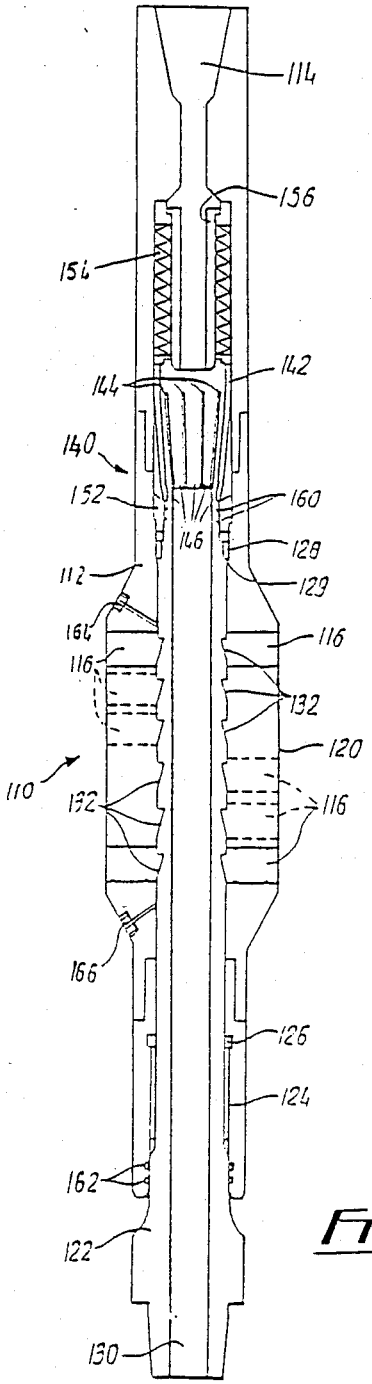

Turning now to the second embodiment of the downhole stabiliser illustrated in FIG. 4, this is generally similar to the first embodiment of FIGS. 1, 2 and 3, and differs mainly in proportions and relative dimensions of certain components. In FIG. 4, components which correspond to those in FIGS. 1 to 3 are given the same reference numeral prefixed by a "1" (i.e. the same number plus one hundred) for simplicity of comparison.

The principal differences between the two embodiments (which do not affect the principles of the invention) are as follows:

(A) The helical buttresses 20 are merged into a continuous enlarged-diameter portion 120 at the mid-length of the stabiliser 110;

(B) The radial spacers 116 are re-shaped to avoid steps in their diameters, and form a more dense array since a greater number are distributed in the same six axially spaced rows as previously.

(C) The stack of belleville washers forming the spring 154 are increased in number and overall length for greater pre-load range variation capabilities;

(D) The cage 156 is increased in length to match the increase in dimensions of the spring 154;

(E) The resilient annular catch 142 is axially longer, and the free ends of the resilient fingers are re-shaped for increased strength and wear-resistance.

(F) The separate keys 24 are replaced by splines 124 integrally formed on the inside of the casing 112 and on the outside of the mandrel 122; these splines 124 mesh to allow relative axial movement of the casing 112 with respect to the mandrel 122 while preventing relative rotation.

(G) The mandrel 122 is restrained from being pulled out of the casing 112 and their relative axial movement is limited by means of a retaining ring 128 screwed on to the inner end of the mandrel 122. In the axially extended condition of the stabiliser 110, the ring 128 abuts an internal shoulder 129 in the central bore of the casing 112. In the axially contracted condition of the stabiliser 110, the ring 128 abuts the lower end of the fixed catch restraint 152.

(H) The inner end of the mandrel 112 near the shoulder ramp 150 is slidingly sealed to the catch restraint 152 (which is fixed to the inside of the casing 112) by two O-rings 160 each fitted in a respective circumferential groove in the periphery of the mandrel 122.

(I) The outer end of the mandrel 122 near the string coupling 130 is slidingly sealed to the inside of the casing 112 by two O-rings 162 each fitted in a respective circumferential groove in the inner wall of the casing 112.

(J) The casing 112 is penetrated by two oil-injection valve ports 164 and 166. Prior to use of the stabiliser 110, lubricating oil is injected under pressure through one of these ports (164 or 166), while the interior of the casing 112 is simultaneously vented of air through the other one of these ports. Thus, the interior of the stabiliser 110 is fitted with pressurised lubricating oil within the volume bounded by the interior of the casing 112, the exterior of the mandrel 122, and the O-ring seals 160 and 162. This pressurised oil lubricates the moving parts and resists the ingress of drilling mud and drilling debris during downhole operation. One or more axial grooves (not illustrated) extend along the surface of the mandrel 122 from the region of the splines 124 to just below the upper O-ring seals 160 to allow free movement of the lubricating oil within the stabiliser 110 as it telescopingly extends and contracts.

Figures 5A, 5B:
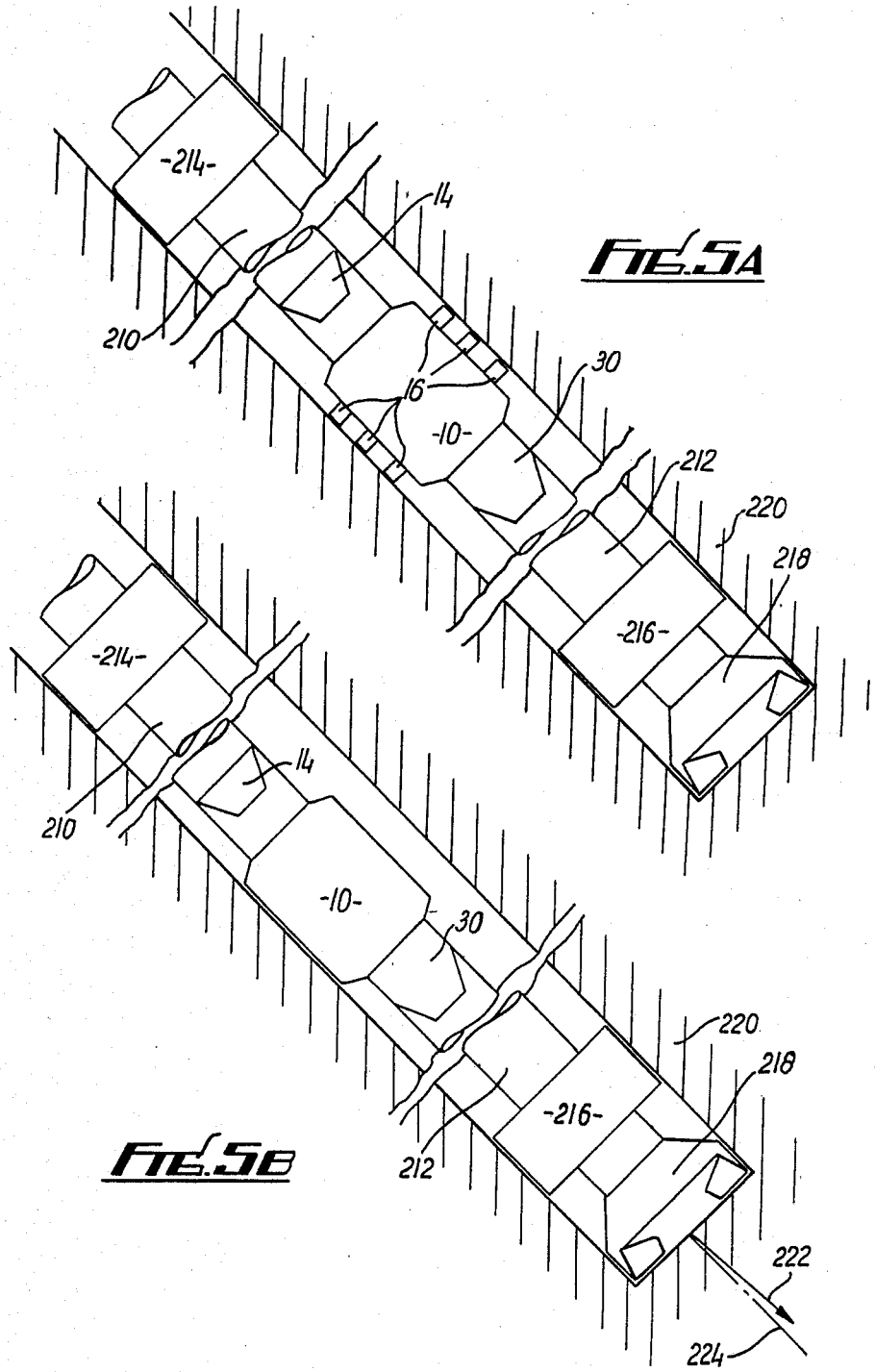
FIGS. 5A and 5B are each schematic diagrams of the downhole stabilisers in use as part of a drill string.

FIGS. 5A and 5B show the downhole stabiliser in use as part of a drill string which is drilling a well at a substantial inclination to vertical. Both of FIGS. 5A and 5B are highly schematic diagrams, and each is greatly foreshortened by removal of two substantial lengths of the string. While the first embodiment of downhole stabiliser (i.e. the stabiliser of FIGS. 1 to 3) is shown in FIGS. 5A and 5B, the following description applies equally to the second embodiment of FIG. 4.

In FIG. 5A, the stabiliser 10 is coupled into the string by being screwed onto adjacent drill pipes 210 and 212 by means of the string couplings 14 and 30. These drill pipes 210 and 212 are fitted with respective collars 214 and 216 which each functions as a fixed diameter stabiliser. The lower end of the drill pipe 212 is fitted with a drill bit 215 to cut through surrounding geological formation 220.

In FIG. 5A, the stabiliser 10 has its radial spacers 16 radially extended to give the stabiliser 10 its maximum effective diameter. This centralises the drill string between the fixed diameter stabilisers or collars 214 and 216, and the drill bit 218 will normally cut in a straight line (unless forced to deviate by, for example, an inhomogeneity in the surrounding geological material 220).

When it is required to change the direction of drilling, the top end of the drill string is lifted at the surface until the weight of the lower string components 212, 216 and 218 is suspended from the stabiliser 10 instead of resting on the bottom of the well (through the cutters on the drill bit 218). As previously described, this releases the radial spacers 16, and allows them to retract inside the stabiliser 10 under peripheral forces as the string rotates in the well.

Due to the lengths of drill pipe 210 and 212 on either side of the stabiliser 10 before the next points of support at the collars 214 and 216, the reduced diameter stabiliser 10 allows the inclined drill string to sag between the fixed-diameter collars 214 and 216, as shown in FIG. 5B. The net result of this bend in the lower end of the drill string is that the drill bit 218 will head in a new direction 222 at a small angle to the previous straight drilling direction 224. Since the drill string will sag to the lower side of the well being drilled, the new direction 222 will tend to be vertically above the previous direction 224, and the well will increase its deviation from the vertical towards the horizontal. Experiments suggest a capability of deviating by 0.2 degrees per thirty meters drilled in North Sea bedrock.

The downhole stabiliser 10 is suitable for use with oil well equipment drilling wells at a standard diameter of twelve and one quarter inches (approximately 31 millimeters). By suitable choice of the angles of the camming surfaces within the stabiliser 10, the minimum and maximum effective diameters can be selected as follows:

15 degrees:- 11¾–12 3/16 inches (29.85–30.95 mm);

10 degrees:- 11⅞–12⅛ inches (30.2–30.8 mm);

5 degrees:- 12–12⅛ inches (30.5–30.8 mm);

(metric equivalents are approximate).

The drill string may be rotationally driven from the surface location, or the lower end of the drill string may incorporate a downhole motor to drive the drill bit directly and without rotationally driving the entire length of the drill string.

Other modifications and variations may be made within the scope of the invention as defined in the appended claims.

I claim:

1. A downhole stabiliser for use in a drill string, the stabiliser having an effective diameter which is selectively variable between a minimum diameter and a maximum diameter, the stabiliser comprising a hollow and generally cylindrical casing having a string coupling at one end thereof, the casing mounting an angularly distributed array of radially movable radial spacers whose radially outer ends define said effective diameter, the casing internally and co-axially mounting a spacer actuating mandrel, the mandrel having a string coupling at one end thereof, the string coupling on the casing and the string coupling on the mandrel being at opposite ends of the downhole stabiliser to allow the downhole stabiliser to be operatively coupled into the drill string in use, the stabiliser being capable of telescopic contraction and extension between said string couplings by means of axially limited insertion of said mandrel into said casing and withdrawal of said mandrel from said casing, said mandrel and said casing being coupled to prevent relative rotation thereof, the mandrel having at least one camming surface, the radial spacers each having a camming surface on the respective radially inner end thereof, the camming surfaces on the mandrel and on the radial spacers co-operating to force the radial spacers radially outwards upon telescopic contraction of the downhole stabiliser by increased insertion of the mandrel into the casing, a mechanical detent within said casing and linking the casing with the mandrel in an axially extended condition of the stabiliser to restrain said telescopic contraction of the stabiliser while axially compressive forces on the stabiliser remain below a predetermined critical force, said detent being operable by application to the downhole stabiliser of an axially compressive force exceeding said critical force to release the mandrel from the casing to allow said telescopic contraction of the downhole stabiliser and consequent radial extension of said radial spacers, said detent allowing the stabiliser to remain in the contracted condition to retain said radial spacers in their radially outward positions until axially compressive forces on the stabiliser fall below a predetermined minimum axially compressive force to release the mandrel relative to the casing thus to allow the stabiliser to return to the axially extended condition and consequently to allow radial retraction of the radial spacers.

2. A downhole stabiliser as claimed in claim 1, wherein the casing, the mandrel, and both string couplings are hollow throughout the length of the stabiliser and are mutually sealed to be substantially fluid-tight to permit drilling mud to be pumped under pressure through the stabiliser when it is incorporated as part of a drill string.

3. A downhole stabiliser as claimed in claim 1, wherein the mechanical detent is a resilient catch coupled through a spring to the casing, said spring having a pre-load thereon which determines said critical force, said catch being coupled to the mandrel in the telescopically extended condition of the stabiliser through a ramp formed on the mandrel, application to the stabiliser of an axially compressive force exceeding said critical force causing contraction of the pre-loaded spring and riding of the catch over said ramp to allow said increased insertion of the mandrel into the casing.

4. A downhole stabiliser as claimed in claim 3, wherein the casing includes a catch restraint which restrains the catch from riding over the ramp while the spring is uncontracted in the absence of an axially compressive force on the stabiliser which is in excess of the critical force.

5. A downhole stabiliser as claimed in claim 4 wherein said resilient catch is formed as an annular array of fingers each free at one end and integral at the other end with the other fingers, the material of which the catch is formed giving resilient movement to the free ends of the fingers, the ramp on the mandrel being formed as an annular shoulder against which the free ends of the fingers are resiliently contracted.

6. A downhole stabiliser as claimed in claim 5, wherein the catch restraint is an annular intrusion on the inner surface of the casing and bearing against the free ends of the catch fingers in the telescopically extended condition of the stabiliser to give positive restraint to the free ends of the fingers and to prevent the free ends of the fingers from riding over the annular shoulder on the mandrel prior to initiation of telescopic contraction of the stabiliser by application of an axial compressive force in excess of the critical force.

7. A downhole stabiliser as claimed in claim 3 wherein the spring comprises a stack of belleville washers held in a cage between end stops which limit axial expansion of the stack to provide said pre-load.

8. A downhole stabiliser as claimed in claim 1 wherein the mandrel has the or each camming surface thereon formed as a respective conical surface co-axial with the mandrel.

9. A downhole stabiliser as claimed in claim 1 wherein, adjacent spacers in said array are mutually angularly spaced by substantially equal angles around the periphery of the stabiliser.

10. A downhole stabiliser as claimed in claim 9, wherein said angularly distributed radial spacers are also axially distributed with adjacent spacers in said array being mutually axially spaced along the periphery of the stabiliser.

11. A downhole stabiliser as claimed in claim 10, wherein said array of spacers forms at least one helix on the periphery of the stabiliser with successive spacers in the or each helix being mutually spaced at substantially regular increments of angle and of axial separation.

12. A downhole stabiliser as claimed in claim 11, wherein said array of spacers forms three mutually equidistant helices.

13. A downhole stabiliser as claimed in claim 1, wherein each radial spacer is a substantially cylindrical body slidingly mounted in a respective substantially cylindrical hole in the stabiliser, and with the axis of each such cylindrical body aligned substantially at right angles to the axis of the stabiliser.

14. A downhole stabiliser as claimed in claim 13, wherein the radially outer end of each radial spacer is coated or otherwise covered with a layer of non-ferrous wear-resistant material.

15. A downhole stabiliser as claimed in claim 14, wherein said non-ferrous wear-resistant material is tungsten carbide.

* * * * *